US006220901B1

(12) United States Patent
Fisher et al.

(10) Patent No.: US 6,220,901 B1
(45) Date of Patent: Apr. 24, 2001

(54) ELECTRIC MOTOR TERMINAL BOARD ASSEMBLY

(75) Inventors: L. Edwin Fisher; James A. Butcher; Marc D. Pape; David R. Blake, all of Ft. Wayne, IN (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/070,596

(22) Filed: Apr. 30, 1998

(51) Int. Cl.[7] ..... H01R 9/22
(52) U.S. Cl. ..... 439/709; 439/712
(58) Field of Search ..... 439/709–712, 439/715, 716, 717, 719

(56) References Cited

U.S. PATENT DOCUMENTS

| | | | | |
|---|---|---|---|---|
| 4,458,974 | * | 7/1984 | Knickerbocker | 439/709 |
| 4,775,324 | * | 10/1988 | Norden | 439/709 |
| 5,588,881 | * | 12/1996 | Eggert et al. | 439/709 |
| 5,989,074 | * | 11/1999 | Miller et al. | 439/709 |

* cited by examiner

*Primary Examiner*—Brian Sircus
*Assistant Examiner*—Hae Moon Hyeon
(74) *Attorney, Agent, or Firm*—Carl B. Horton, Esq.; Damian Wasserbauer, Esq.; Armstrong Teasdale LLP

(57) ABSTRACT

A terminal board assembly for an electric motor is described. The terminal board assembly is configured to mount inside an electric motor terminal or conduit box and includes a terminal board and a mounting bracket. The terminal board includes six terminal studs and three connecting bars extending between the terminal studs. Quick connect spade type connectors are coupled to the six terminal studs adjacent the bottom of the terminal board to facilitate quick and easy connection of the wire connection leads of an electric motor. The terminal studs and connecting bars permit a choice of "Y" or "Delta" voltage connections to the electric motor. The terminal board also includes a first and a second slot positioned at, and parallel to, opposing ends of the board. The mounting bracket includes a base portion and first and second side portions depending from opposing ends of the base portion. An engaging portion extends from each side portion and is configured to extend through the slots positioned at the opposing ends of the terminal board. Each engaging portion includes a retaining tab configured to engage the terminal board. The base portion of the mounting bracket includes at least one mounting opening for attaching the bracket to the electric motor conduit box.

17 Claims, 3 Drawing Sheets

ELECTRIC MOTOR TERMINAL BOARD ASSEMBLY

FIELD OF THE INVENTION

This invention relates generally to electric motors and more particularly, to a terminal board assembly for connecting motor leads to power line leads.

BACKGROUND OF THE INVENTION

Electric motors sold for use in the United States often include multiple loose wire leads for connecting to the power line connecting leads. The wire leads and the power line connecting leads are connected, typically with wire nuts, in a conduit or terminal box attached to the motor housing. European standards require, however, that electric motors include a six stud connector block with connecting bars for setting "Y" or "Delta" voltage selections, mounted in the conduit box. The motor leads are attached to the connector block, usually with eyelet type connectors. To connect the motor to the power line, the power line leads must be connected to the proper terminal studs.

Electric motors manufactured to European standards using commercially available European type connector blocks with eyelet connectors are expensive to manufacture. Increased labor costs are incurred due to the increased time needed to mount the terminal block and to connect the leads using the eyelet connectors.

It would be desirable to provide a motor connector block meeting European standards that can be easily and quickly installed in the motor terminal box. It would further be desirable to provide a connector block that can be easily and quickly removed from the motor terminal box for service or replacement.

SUMMARY OF THE INVENTION

These and other objects may be attained by a terminal board assembly configured to mount inside an electric motor conduit box and including a terminal board and a mounting bracket. The terminal board includes six terminal studs and three connecting bars extending between terminal studs configured to meet the European standards for electric motor connections to power line leads. Quick connect spade type connectors are coupled to the six terminal studs adjacent the bottom of the terminal board to facilitate quick and easy connection of the wire connection leads of an electric motor. The terminal studs and connecting bars permit a choice of "Y" or "Delta" voltage connections to the electric motor. The terminal board also includes a first and a second slot positioned at, and parallel to, opposing ends of the board for securing the terminal board to the mounting bracket as described below.

The mounting bracket includes a base portion and first and second side portions depending from opposing ends of the base portion. An engaging portion extends from each side portion and is configured to extend through the slots positioned at the opposing ends of the terminal board. Each engaging portion includes a retaining tab configured to engage the terminal board. The base portion of the mounting bracket includes at least one mounting opening for attaching the bracket to the electric motor conduit box.

To install the terminal board assembly in an electric motor conduit box, the mounting bracket is mounted inside the conduit box with mounting screws. The terminal board is then installed by positioning the board so that the slots in the board are positioned over the engaging portions of the mounting bracket. The terminal board is then pushed down onto the bracket so that the bottom of the board contacts the edge of the bracket side portions adjacent the base of the engaging portions, and the retaining tabs engage the board thereby securing the board in place. The motor wire leads may be connected to the board either before or after the board is secured in the mounting bracket.

The above-described terminal board assembly includes quick connect terminal connectors for quick and easy connection of the electric motor wire connection leads to the board. Additionally, the mounting bracket permits the terminal board to "snap in place" in the conduit box without the use of additional fasteners. The "snap in place" mounting bracket permits easy installation and easy removal of the terminal board for possible service, replacement, or installation of the power line connection leads.

DETAILED DESCRIPTION

Figure 1:
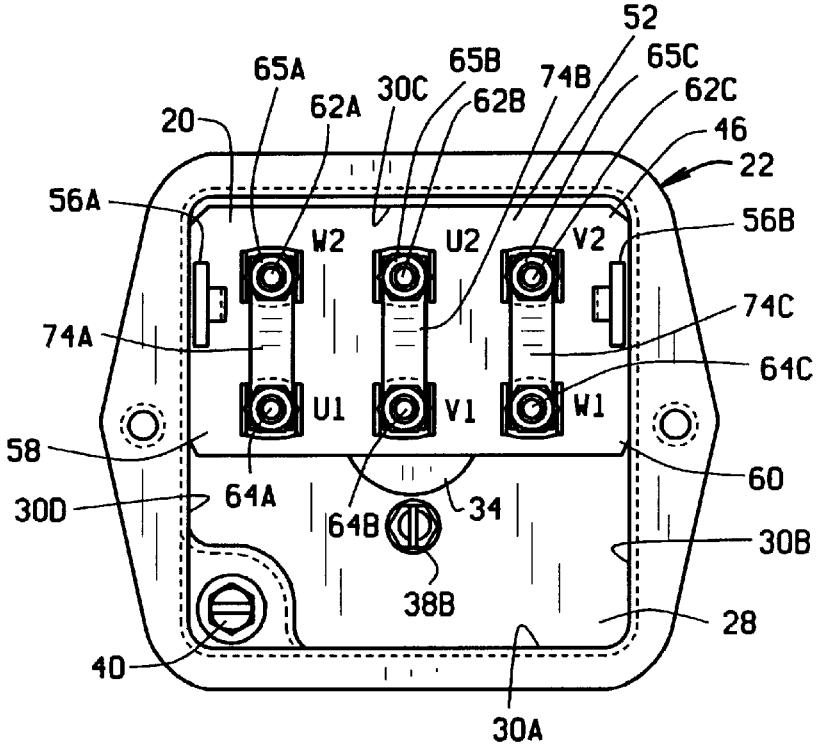
FIG. 1 is a top view of a terminal board assembly in accordance with one embodiment of the present invention mounted in an electric motor conduit box.
Figure 2:
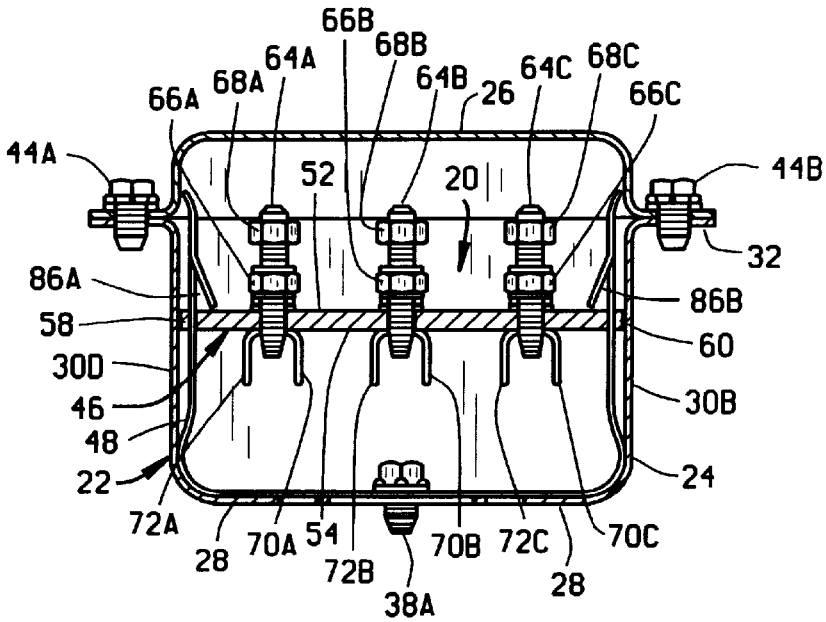
FIG. 2 is a front cross sectional view of the terminal board assembly and electric motor conduit box shown in FIG. 1.
Figure 3:
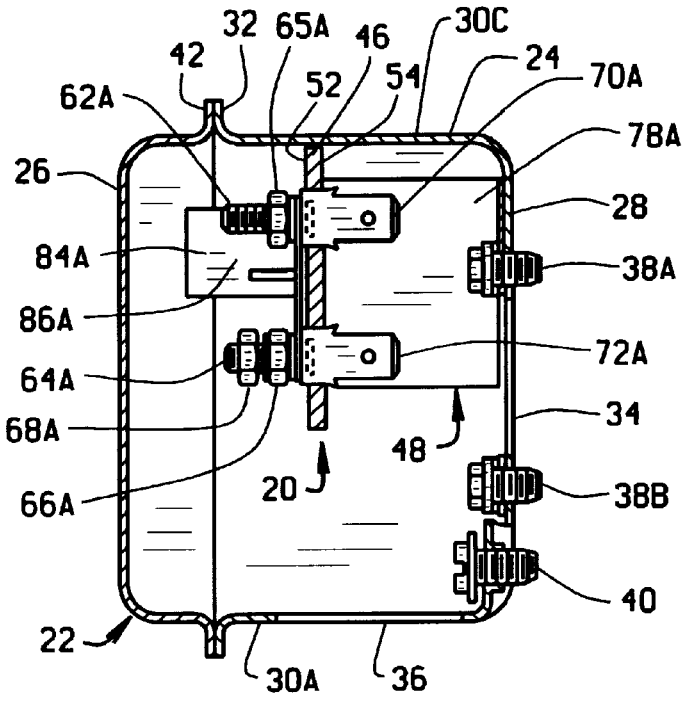
FIG. 3 is a side cross sectional view of the terminal board assembly and electric motor conduit box shown in FIG. 1.

Referring to FIGS. 1, 2, and 3, a terminal board assembly 20 in accordance with one embodiment of the present invention is shown mounted inside an electric motor terminal or conduit box 22. Conduit box 22 includes a base member 24 and a cover member 26. Base member 24 has the general shape of an open top box and includes a bottom 28, four sides 30A, 30B, 30C, and 30D, and a sealing flange 32 extending from sides 30A, 30B, 30C, and 30D. An opening 34 (see FIGS. 1 and 3) extends through bottom 28 of base member 24 to permit electric motor lead wires (not shown) to enter conduit box 22. Another opening 36 (see FIG. 3) extends through side 30A to permit power line connection wires (not shown) to enter conduit box 22. Mounting screws 38A and 38B extend through bottom 28 to secure conduit box 22 to an electric motor (not shown). A ground screw 40 (see FIGS. 1 and 3) extends through bottom 28 of base member 24. Cover 26 is configured to be secured to base member 24 and includes a sealing flange 42 configured to mate with sealing flange 32 of base member 24. Cover 26 is mounted to base member 24 with cover mounting screws 44A and 44B (see FIG. 2) which extend through sealing flanges 32 and 42 at opposing ends of conduit box 22. In another embodiment, conduit box 22 may be remotely mounted from the electric motor (not shown). In such a configuration, the electric motor wire leads are routed through a conduit extending between the motor and conduit box 22.

Terminal board assembly 20 includes a terminal board 46 and a mounting bracket 48. Terminal board 46 is configured to fit inside conduit box 22 and includes a first surface 52 and a second surface 54. Elongate slots 56A and 56B are located at opposing ends 58 and 60 of terminal board 46 (see FIG. 1). Slots 56A and 56B are configured to engage mounting bracket 48, and are parallel to ends 58 and 60. Terminal board 46 includes six terminal studs 62A, 62B, 62C, 64A, 64B, and 64C. Terminal studs 62A, 62B, and 62C are threaded type studs, and include nuts 65A, 65B, and 65C. Terminal studs 64A, 64B, and 64C are threaded type studs and include nuts 66A and 68A, 66B and 68B, and 66C and 68C respectively (see FIG. 2 and 3). Quick connect spade type terminals 70A, 70B, 70C, 72A, 72B, and 72C are coupled to terminal studs 62A, 62B, 62C, 64A, 64B, and 64C respectively and are positioned adjacent to second surface 54 of terminal board 46. Of course, quick connect terminals 70A, 70B, 70C, 72A, 72B, and 72C may be any suitable type quick connect terminal. Connecting bars 74A, 74B, and 74C extend between and connect to studs 62A and 64A, studs 62B and 64B, and studs 62C and 64C, respectively (see FIG. 1). This configuration provides a "Delta" voltage connection to the electric motor. Different configurations of connecting bars 74A, 74B, and 74C between terminal studs 62A, 62B, 62C, 64A, 64B, and 64C, permit a choice of "Y" or "Delta" voltage connections to the electric motor.

Figure 4:
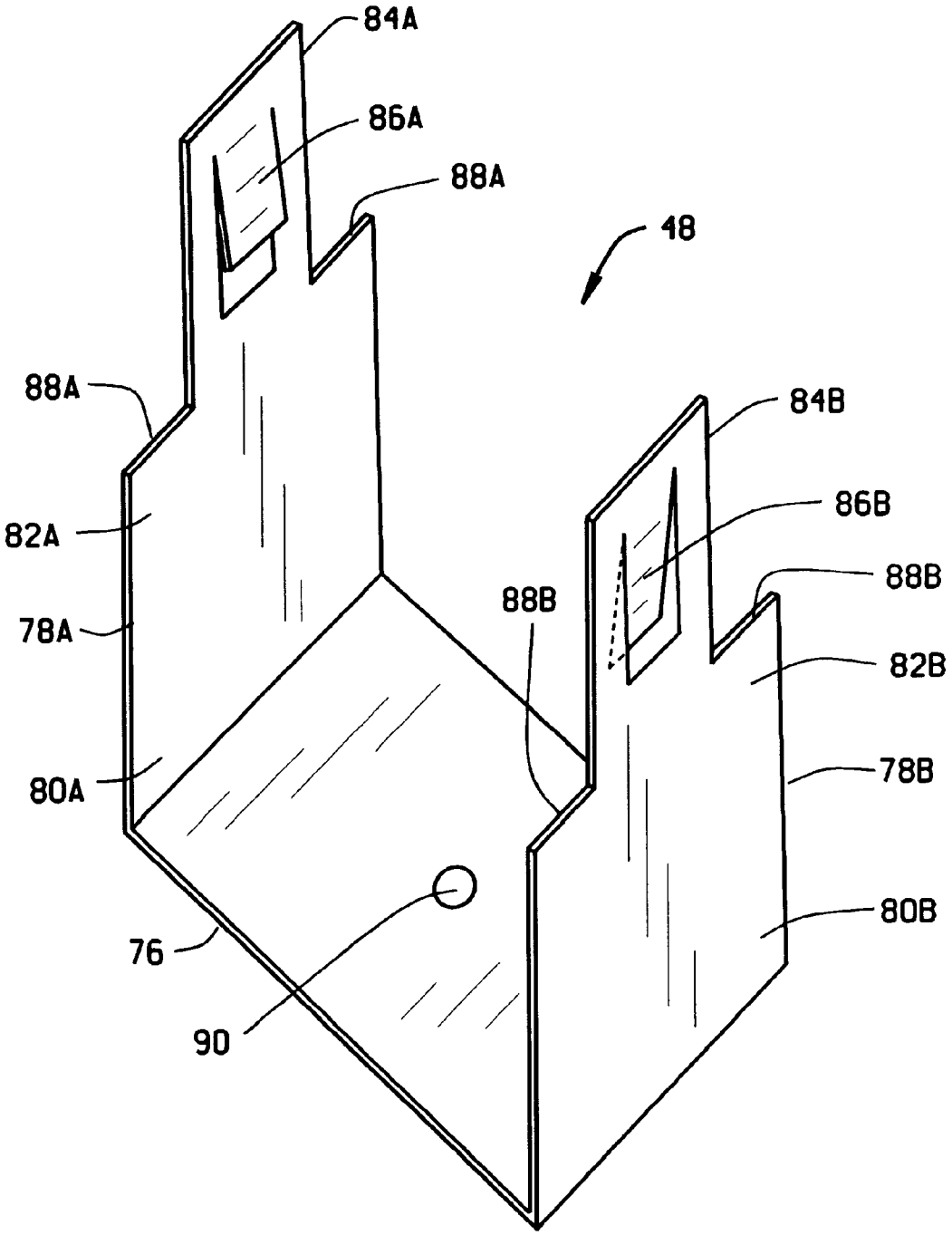
FIG. 4 is a perspective view of the mounting bracket of the terminal board assembly shown in FIG. 1.

Referring to FIG. 4, mounting bracket 48 is configured to fit inside conduit box 22 and includes a base portion 76 and side portions 78A and 78B depending from opposing sides of base portion 74. Side portions 78A and 78B include first ends 80A and 80B, and second ends 82A and 82B, respectively. Engaging portions 84A and 84B extend from second ends 82A and 82B of side portions 78A and 78B respectively and are configured to extend through the slots 56A and 56B. Engaging portions 84A and 84B include retaining tabs 86A and 86B respectively which are configured to engage terminal board 22. Side portions 78A and 78B are wider than engaging portions 84A and 84B and include edges 88A and 88B adjacent to engaging portions 84A and 84B. Mounting opening 90 extends through base portion 76. Mounting screw 38A (shown in FIG. 3) extends through mounting opening 90 and secures mounting bracket 48 to bottom 28 of conduit box 22. Mounting bracket 48 may be fabricated from sheet metal. Some non-limiting examples of sheet metal include, for example, galvanized steel, aluminum, and stainless steel.

To install terminal board assembly 20 in electric motor conduit box 22, mounting bracket 48 is mounted to conduit box 22 with mounting screw 38A. Terminal board 46 is then installed by positioning board 46 so that slots 56A and 56B are positioned over engaging portions 84A and 84B of mounting bracket 48. Terminal board 46 is then pushed down onto bracket 48 so that second surface 54 of board 46 contacts bracket edges 88A and 88B of side portions 78A and 78B, and bracket retaining tabs 86A and 86B engage board 46 thereby securing board 46 in place. Typically, the electric motor wire leads (not shown) are connected to terminal board 46 before board 46 is secured in mounting bracket 48. Particularly, the motor wire leads are connected to the appropriate quick connect terminal connectors 70A, 70B, 70C, 72A, 72B, and 72C. However, the motor wire leads may also be connected to terminal board 46 after board 46 is secured in mounting bracket 48.

Terminal board 46 may be easily removed from conduit box 22 for possible service or to connect power line connection leads (not shown). Particularly, terminal board 46 is removed from box 22 by disengaging retaining tabs 86A and 86B from board 46 and sliding board 46 off engaging portions 84A and 84B of mounting bracket 48.

Figure 5:
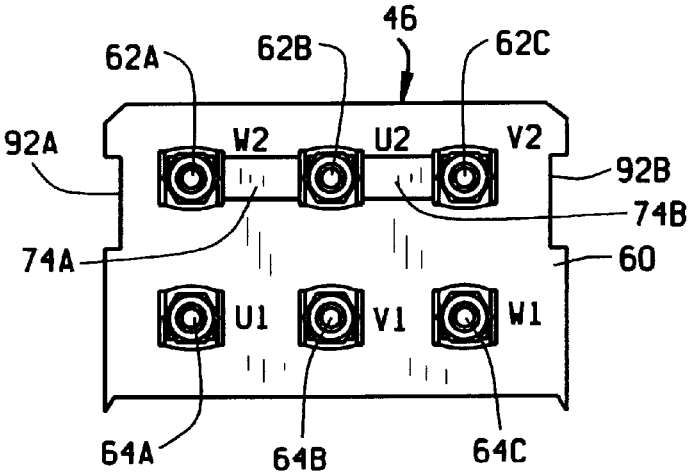
FIG. 5 is a top view of a terminal board in accordance with another embodiment of the present invention.

FIG. 5 illustrates an alternative embodiment of terminal board 46 which includes notches 92A and 92B located at ends 58 and 60 respectively in place of slots 56A and 56B. FIG. 5 also illustrates the configuration of connecting bars 74 for a "Y" voltage connection. Terminal board 46 is configured for a "Y" voltage connection to the electric motor. Particularly, connecting bars 74A and 74B are connected between studs 62A and 62B, and 62B and 62C respectively to provide for a "Y" voltage connection to the electric motor.

The above-described terminal board assembly 20 includes quick connect terminal connectors 70A, 70B, 70C, 72A, 72B, and 72C for quick and easy connection of the electric motor wire connection leads to board 46. Additionally, assembly 20 includes mounting bracket 48 that permits terminal board 46 to "snap in place" in conduit box 22 without the use of additional fasteners. "Snap in place" mounting bracket 48 permits easy installation and easy removal of terminal board 46 for possible service or installation of the power line connection leads.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A terminal board assembly for an electric motor including a conduit box, said assembly comprising:

a terminal board configured to fit inside an electric motor conduit box, said terminal board comprising a plurality of terminal studs and a plurality of connecting bars extending between and coupled to said terminal studs; and a mounting bracket comprising a base portion, a first and a second side portion depending from opposing ends of said base portion, and engaging portions extending from each side portion, each said engaging portion comprising a retaining tab configured to engage said terminal board to provide a snap-in-place engagement with said terminal board, said mounting bracket configured to fit inside of and attach to the electric motor conduit box.

2. A terminal board assembly in accordance with claim 1 wherein said terminal board comprises six terminal studs.

3. A terminal board assembly in accordance with claim 2 wherein said terminal board further comprises three connecting bars, each said connecting bar extending between and coupled to two terminal studs and configured so as to provide a "Delta" voltage connection.

4. A terminal board assembly in accordance with claim 2 wherein said terminal board further comprises two connecting bars, each said connecting bar extending between and coupled to two terminal studs and configured so as to provide a "Y" voltage connection.

5. A terminal board assembly in accordance with claim 2 wherein said terminal studs further comprise quick connect terminals coupled to said terminal studs.

6. A terminal board assembly in accordance with claim 5 wherein said quick connect terminals comprise spade type quick connect terminals.

7. A terminal board assembly in accordance with claim 1 wherein said terminal board further comprises a first and second slot positioned at opposing ends of said terminal board and configured to permit said engaging portions of said mounting bracket to extend through said terminal board.

8. A terminal board assembly in accordance with claim 1 wherein said terminal board further comprises a first and second engagement notch positioned at opposing ends of said terminal board and configured to engage said engaging portions of said mounting bracket.

9. A terminal box assembly for an electric motor said assembly comprising:

a conduit box comprising a base box portion and a cover portion;

a terminal board configured to fit inside said conduit box, said terminal board comprising a plurality of terminal studs and a plurality of connecting bars extending between and coupled to said terminal studs; and a mounting bracket comprising a base portion, a first and a second side portion depending from opposing ends of said base portion, and engaging portions extending from each side portion, each said engaging portion comprising a retaining tab configured to engage said terminal board to provide a snap-in-place engagement with said terminal board, said mounting bracket configured to fit inside of and attach to said conduit box.

10. A terminal box assembly in accordance with claim 9 wherein said terminal board comprises six terminal studs.

11. A terminal box assembly in accordance with claim 10 wherein said terminal board further comprises three connecting bars, each said connecting bar extending between and coupled to two terminal studs and configured to provide a "Delta" voltage connection.

12. A terminal box assembly in accordance with claim 10 wherein said terminal board further comprises two connecting bars, each said connecting bar extending between and coupled to two terminal studs and configured to provide a "Y" voltage connection.

13. A terminal box assembly in accordance with claim 9 wherein said terminal studs further comprise quick connect terminals coupled to said terminal studs.

14. A terminal box assembly in accordance with claim 13 wherein said quick connect terminals comprise spade type quick connect terminals.

15. A terminal box assembly in accordance with claim 9 wherein said terminal board further comprises a first and second slot positioned at opposing ends of said terminal board and configured to permit said engaging portions of said mounting bracket to extend through said terminal board.

16. A terminal box assembly in accordance with claim 9 wherein said terminal board further comprises a first and second engagement notch positioned at opposing ends of said terminal board and configured to engage said engaging portions of said mounting bracket.

17. A terminal board assembly for an electric motor including a conduit box, said assembly comprising:

a terminal board configured to fit inside an electric motor conduit box, said terminal board comprising a plurality of terminal studs and a plurality of connecting bars extending between and coupled to said terminal studs, each said terminal stud comprising a quick connect terminal coupled to said stud; and a mounting bracket configured to fit inside of and attach to the electric motor conduit box, and to provide a snap-in-place engagement with said terminal board.

* * * * *